US008855347B2

(12) United States Patent
Aubert

(10) Patent No.: US 8,855,347 B2
(45) Date of Patent: Oct. 7, 2014

(54) HEARING DEVICE WITH A VENT EXTENSION AND METHOD FOR MANUFACTURING SUCH A HEARING DEVICE

(75) Inventor: Sëbastien Aubert, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 13/380,210

(22) PCT Filed: Jun. 30, 2009

(86) PCT No.: PCT/EP2009/058212

§ 371 (c)(1),
(2), (4) Date: Dec. 22, 2011

(87) PCT Pub. No.: WO2009/115618

PCT Pub. Date: Sep. 24, 2009

(65) Prior Publication Data

US 2012/0140967 A1 Jun. 7, 2012

(51) Int. Cl.
*H04R 25/00* (2006.01)

(52) U.S. Cl.
CPC ..... *H04R 25/658* (2013.01); *H04R 25/65* (2013.01); *H04R 2460/11* (2013.01); *H04R 2225/025* (2013.01); *H04R 25/652* (2013.01); *H04R 25/48* (2013.01); *H04R 25/556* (2013.01); *H04R 25/456* (2013.01); *H04R 2225/63* (2013.01); *H04R 2460/17* (2013.01); *H04R 25/656* (2013.01); *H04R 2225/021* (2013.01); *H04R 25/608* (2013.01)
USPC ..... 381/328; 381/330

(58) Field of Classification Search
USPC ..... 381/322, 324, 328, 330, 380, 381
See application file for complete search history.

(56) References Cited

U.S. PATENT DOCUMENTS 4,006,796 A 2/1977 Coehorst
4,291,203 A * 9/1981 Bellafiore ..... 381/328

(Continued)

FOREIGN PATENT DOCUMENTS

DE 10 2006 050 502 A1 4/2008
EP 0517322 A2 12/1992

(Continued)

OTHER PUBLICATIONS

International Search Report for PCT/EP2009/058212 dated Jan. 7, 2010.

(Continued)

*Primary Examiner* — Davetta W Goins
*Assistant Examiner* — Phylesha Dabney
(74) *Attorney, Agent, or Firm* — Pearne & Gordon LLP

(57) ABSTRACT

A hearing device comprises an ear-piece which is designed to be worn at least partially in an ear canal of a user of the hearing device. The ear-piece comprises a vent passage connecting the ear canal with the atmosphere. The vent passage has an inner opening towards the ear-canal and an outer opening towards the atmosphere. The ear-piece further comprises a vent extension. The vent extension is a protrusion extending the vent passage beyond the body of the ear-piece. The vent extension is adapted for abutting on a surface of the body of the user and is thereby inconspicuous and/or contributes thereby to retention. A method for manufacturing such a hearing device is also disclosed.

27 Claims, 4 Drawing Sheets

(56) References Cited

U.S. PATENT DOCUMENTS

| | | | | |
|---|---|---|---|---|
| 4,375,016 | A * | 2/1983 | Harada | 181/135 |
| 4,724,922 | A * | 2/1988 | Kalayjian | 181/135 |
| 4,852,177 | A | 7/1989 | Ambrose | |
| 4,852,683 | A * | 8/1989 | Killion | 181/130 |
| 5,031,219 | A * | 7/1991 | Ward et al. | 381/328 |
| 5,048,090 | A | 9/1991 | Geers | |
| 5,201,007 | A * | 4/1993 | Ward et al. | 381/328 |
| 5,357,576 | A | 10/1994 | Arndt | |
| 6,275,596 | B1 * | 8/2001 | Fretz et al. | 381/321 |
| 7,068,803 | B2 | 6/2006 | Kuhlmann et al. | |
| 7,079,662 | B2 | 7/2006 | Niederdrank | |
| 7,715,581 | B2 * | 5/2010 | Schanz | 381/328 |
| 2008/0301944 | A1 | 12/2008 | Widmer et al. | |

FOREIGN PATENT DOCUMENTS

| | | | |
|---|---|---|---|
| WO | 00/42817 | A1 | 7/2000 |
| WO | 01/43499 | A1 | 6/2001 |
| WO | 2007/014950 | A2 | 2/2007 |

OTHER PUBLICATIONS

Written Opinion for PCT/EP2009/058212 dated Jan. 7, 2010.

* cited by examiner

HEARING DEVICE WITH A VENT EXTENSION AND METHOD FOR MANUFACTURING SUCH A HEARING DEVICE

TECHNICAL FIELD

The invention relates to the field of hearing devices. More particularly, it relates to a hearing device according to the preamble of claim 1 and a method for manufacturing such a device according to claim 15.

BACKGROUND OF THE INVENTION

Hearing devices are devices which relate to the hearing of an individual. They may be hearing aids for compensating a hearing loss, hearing protection against harmful noise, communication devices allowing individuals to speak to each other remotely, inconspicuously and/or in noisy environments, headsets which deliver and/or pick-up sound at the head of an individual or any combination of the before mentioned.

Hearing devices comprise commonly some sort of ear-piece which is positioned substantially in the ear and in particular partially in the ear canal of the user. It thereby closes the ear-canal partially or fully. A so called vent passage is usually provided to avoid a complete closure of the ear canal. Different designs of such vent passages are known from the following documents:

U.S. Pat. No. 4,852,177 discloses an earphone for devices such as radio or tape players. A microphone is provided to allow hearing of outside sounds. There is venting from inside the ear canal to the atmosphere. The vent tube runs out of the housing to a location remote from the microphone to reduce the susceptibility to feedback. Acoustic damping material may be placed inside the tubes.

U.S. Pat. No. 5,357,576 discloses an in-the-canal hearing aid with a protruding shell portion. The vent extends outwardly on the protruding shell portion to a position at the rim to space the outer vent opening away from the microphone to reduce the likelihood of feedback.

WO 01/43499 A1 discloses a completely in-the-canal hearing device. A conduit serves as both a vent and a retrieval cord. The vent tube contributes to the reduction of acoustic feedback.

US 2008/0301944 A1 discloses an in-ear custom-molded ear-plug device with venting grooves. The grooves are helical and surround the custom-molded ear-plug unit.

U.S. Pat. No. 7,079,662 discloses a hearing aid device wearable in the ear having an aeration channel. An acoustic damper may be present in the channel to prevent the occurrence of resonance effects.

Ear-pieces of hearing devices are often secured by some kind of retention means, such a as resilient member abutting on the inside of the concha, which may be called due to its position and function "concha clip". Different designs of retentions means are disclosed in the following documents:

U.S. Pat. No. 7,068,803 discloses an acoustic device with means for being secured in a human ear. It may be a passive noise shield or one with transducers for communication. The securing means is a leaf spring designed to uniformly distribute force on the cartilage arch between the antihelix and the concha. An antenna may be integral with the spring.

DE 10 2006 050 502 A1 discloses a concha clip which is provided for fixing an ear-piece by an attachment in the concha and/or an antihelix. The clip is designed as plastic injection-molded part.

WO 2007/014950 A2 discloses a hearing device. According to the embodiment of FIG. 7 there are an outer ear section and a helix section interconnected with a bridge section. Positioning of the microphone in the helix section creates a large distance between the microphone and the receiver thereby minimizing feedback. Further the helix section assists in retaining the housing in the ear of the wearer.

Generally it can be concluded that there are numerous ways described in the prior art how to arrange hearing devices in and/or around the ear, how to retain them, and how to provide vent passages between the ear canal and the atmosphere. However, each of the known solutions is still imperfect in regard to at least one of the following aspects:

reliability and/or comfort of the retention in the ear;
susceptibility to feedback or maximum stable gain;
inconspicuousness and/or cosmetic appeal;
moisture accumulation in the ear canal;
occlusion perceived by the user;
simplicity of construction and/or manufacturing effort;
effort necessary for the initial adaptation to the user;
maintainability, e.g. cleaning and removal of cerumen;
every-day usability, e.g. insertion and removal.

SUMMARY OF THE INVENTION

In the present document the term "body of an ear-piece" is used to denominate the main portion of an ear-piece of a hearing device. In the case of a common custom-mold ear-piece it comprises the shell, all components arranged within the shell as well as the face plate. In the case of a common one-size-fits-all ear-piece it comprises the casing in which the main electric components, e.g. the receiver, are arranged and consequently all components arranged within this casing. It is not meant to include "extremities" such as pull-out-cords or connectors to modules at other locations such as behind-the-ear.

All aspects of the invention address the general problem of eliminating or reducing one or more of the above mentioned imperfections.

A first aspect of the invention addresses the problem of providing a hearing device with good retention in the ear, with a relatively simple design, with reduced susceptibility to feedback and/or with a cosmetically appealing or inconspicuous appearance.

This problem is solved by the features of claim 1, namely by a hearing device comprising an ear-piece which is designed to be worn at least partially in an ear canal of a user of said hearing device, said ear-piece comprising a vent passage, wherein said vent passage is designed to connect, while said hearing device is worn, a space in said ear canal in front of an eardrum of said user with an environment of said user, said vent passage having an inner opening towards said ear-canal and an outer opening towards said environment, said ear-piece further comprising a vent extension, said vent extension being a protrusion extending said vent-passage beyond a body of said ear-piece, wherein said vent extension is adapted for abutting on a surface of a body of said user.

"Abutting on" means that there is not only a point of contact between two entities, but rather a line or an area of contact between the two entities. In the case of a vent tube abutting on a body, such a line of contact typically runs, when looking at a particular section of the vent tube, in the same direction as the vent tube.

A vent extension on the surface of the body is cosmetically less obstructive than a vent extension sticking out away from the body. By abutting on a surface of the body it opens up the possibility to provide retention and other retention members may be omitted or reduced in size. Due to its inconspicuousness the solution also opens up the possibility to provide relatively long vent extensions. A long vent passage reduces leakage of acoustic energy but may still have a sufficient diameter to be cleaned by standard tools and procedures. A long vent passage also allows moving the outer vent opening away from the microphone which reduces the susceptibility to feedback.

A second aspect of the invention addresses the problem of providing a hearing device accommodating a relatively long vent extension in an ear in an inconspicuous or cosmetically appealing and useful way as well as the problem of providing a hearing device of the kind having a vent extension with especially good retention of its ear-piece without adding to the complexity of the design.

This problem is solved by the features of claim 3.

A combination of concha clip and vent extension has the advantage that only one element needs to be provided and, as the case may be, adjusted to the needs of a user. Further, since the concha has the shape of a bowl, from many angles the vent extension cannot even be seen. At the same time the concha is large enough to allow a reasonable distance between a vent opening and a microphone even if the vent extension is completely contained in the concha.

A third aspect of the invention addresses the problem of providing a hearing device with an especially low susceptibility to feedback and/or having a high user friendliness during everyday use.

This problem is solved by the features of claim 4.

A vent opening outside of the concha provides a good acoustical separation from microphones in the concha. Further a vent extension outside of the concha is relatively easy to grip and may be used as a pull-out cord.

A fourth aspect of the invention addresses the problem of providing a hearing device with comfortable retention in the ear, with reduced susceptibility to feedback and/or with a cosmetically appealing or inconspicuous appearance as well as the problem of providing a method for manufacturing such a device.

This problem is solved by the features of claim 14, as well as by the features of claim 15.

An adaptation of a vent extension to an anatomy of a specific user of the device has the advantages that it opens up the possibility to assure that a force exerted by the vent extension upon the body of the user is evenly distributed and does not cause pressure marks, that it allows to fully exploit the size of the ear, in particular in cases where a long vent extension is desired in regard to feedback and/or retention, and that a cosmetically favorable arrangement can be implemented.

Further embodiments and advantages emerge from the claims and the description referring to the figures.

BRIEF DESCRIPTION OF THE DRAWINGS

Below, the invention is described in more detail by referring to drawings showing exemplified embodiments.

The described embodiments are meant as examples and shall not confine the invention.

DETAILED DESCRIPTION OF THE INVENTION

Figure 1:
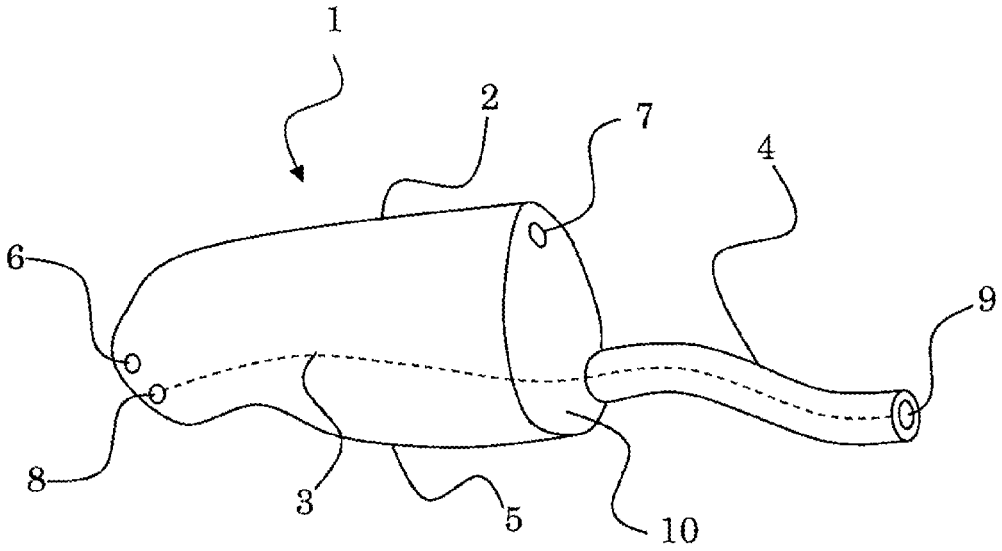
FIG. 1 shows an ear-piece of a hearing device with a vent extension.

FIG. 1 shows an ear-piece 1 of a hearing device according to one embodiment of the invention. The hearing device may be an in-the-ear hearing aid. The ear-piece 1 is designed to be worn at least partially in an ear canal of a user of the hearing device and may therefore also be denominated ear-plug. It delivers sound into the ear canal by a receiver opening 6. It comprises a body 2 the surface of which may be formed by a shell and a faceplate. Through this body 2 there is a vent passage 3 connecting the ear canal with the atmosphere, i.e. the environment of the user. The vent passage 3 has an inner opening 8 towards the ear-canal and an outer opening 9 towards the atmosphere. The vent passage 3 serves for pressure equalization, against moisture built up in the ear canal as well as against the so-called occlusion effect which is perceived by individuals when their ear-canal is not sufficiently open to the atmosphere. There is a vent extension 4 which is a protrusion or prolongation extending the vent passage 3 beyond the body 2, i.e. beyond shell and faceplate. It is tubular, i.e. it has substantially the shape of a tube. The vent extension 4 has the advantage that it moves the outer opening 9 of the vent passage 3 away from a microphone opening 7 and thereby reduces the susceptibility to feedback. It further increases the overall length of the vent passage 3. Length and diameter of a vent passage are important parameters in acoustic modeling. Both influence the so-called vent mass. The vent mass is a measure proportional to the length (l) and inversely proportional to the sectional area (A) of the vent passage. A high vent mass is usually required for severe and profound hearing losses and is difficult to accommodated in short ear-pieces without vent extension. The vent extension 4 has preferably a length of at least 10 mm, at least 15 mm, at least 20 mm or at least 25 mm. The casing or shell of body 2 may be an ear mold, custom made, in particular from a substantially hard material, e.g. a suitable acrylic, designed to fit a specific ear of a specific individual. It may be made by a printing process according to data derived from an ear impression of the individual. Alternatively, a soft material may be used for a one-size-fits-all or -many solutions.

Figure 2:
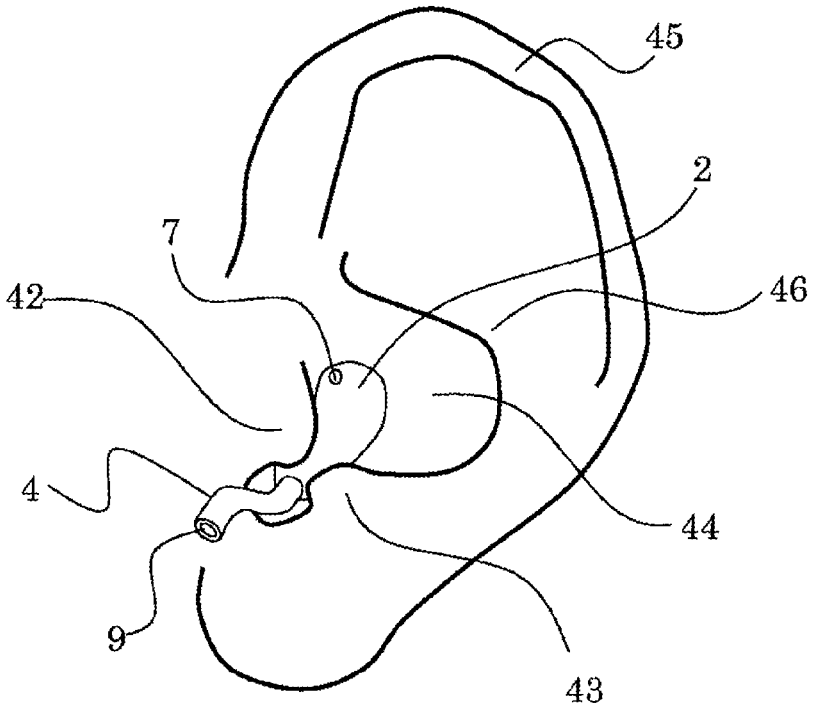
FIG. 2 shows an ear-piece of a hearing device while being worn in an ear of a user with a vent extension having its outer opening outside of the concha, in the range of the lobulus.

FIG. 2 shows an ear-piece of a hearing device according to one embodiment of the invention with a body 2 and a vent extension 4 while being worn in an ear of a user. The ear-piece is substantially an ear-piece of the kind described referring to FIG. 1. However, the vent extension 4 is bent in such a way, that it optimally abuts on the surface of the body outside of the concha 44. The hearing device may be an in-the-ear hearing aid. The parts of the ear can be referred to by conventional anatomic terms, namely tragus 42, antitragus 43, concha 44, helix 45 and antihelix 46. The microphone opening 7 is located within the concha. This has the advantage that the picked up sound is closest to what would be perceived by normal hearing and without hearing device, since the directionality and amplification provided by the shape of the ear or pinna is preserved.

Conventional in-the-ear hearing aids have the outer opening of the vent passage in the concha as well which is problematic in regard to feedback. According to the shown embodiment the outer opening 9 of the vent passage is outside of the concha 44 which is best to keep amplified sound away from the microphone opening 7. The microphone opening 7 is in the upper region of the ear piece body 2. The protruding portion of the vent extension starts at the lower region of the ear piece body 2. A design with the vent opening outside of the concha is especially suited for severe and profound hearing losses and might even be the enabling feature for fitting such patients with completely-in-the-canal hearing aids. The gain before feedback is up to 10 dB higher than for solutions without such a vent extension. The distance between outer opening 9 and microphone opening 7 preferably is larger than 10 mm, in particular larger than 20 mm, and in particular larger than 30 mm. The vent extension 4 has been adapted to the anatomy of the user, i.e. more precisely of a specific individual which will be substantially the sole person wearing the device. It abuts on the surface of the body of the user, in particular substantially over its full length or at least over 10 mm or at least over half its length, in particular its distal half. Preferably it abuts on the surface of the body of the user outside the concha 44, in particular over a length of at least 5 mm or at least 25% of its length. It is cosmetically relatively unobtrusive when it is abutting directly on the surface of the body, i.e. it is not sticking away from the body. It thereby also contributes to retention of the ear-piece. The outer opening 9 is in reference to the concha 44 opposite to the helix 45, i.e. opposite to where a behind-the-ear module could be positioned, thereby having, if applicable, an especially large distance to such a module. The vent extension 4 may, for example, be made from a thermoplastic resilient material, such that it can be bent permanently by an audiologist during a fitting session to optimally suit the anatomy of a specific individual and resiliently by the user during mounting and/or everyday use. Further, a tube-shaped design allows easy adjustment of the length. In one embodiment the vent extension has a bending or is bent by at least 10° and in particular by at least 20°.

Figure 3:
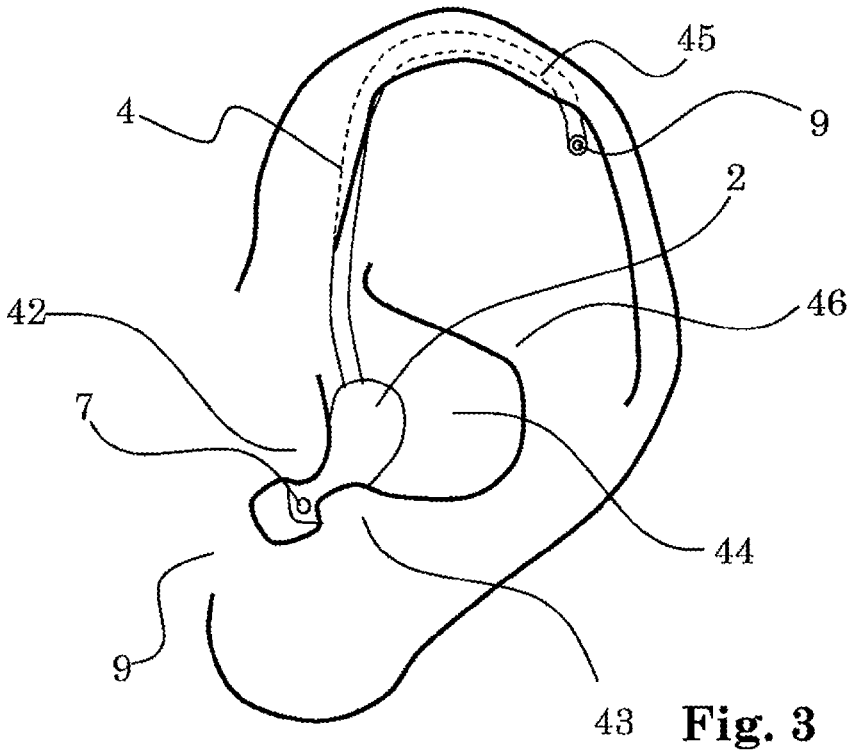
FIG. 3 shows an ear-piece of a hearing device while being worn in an ear of a user with a vent extension abutting on the helix.

FIG. 3 shows an ear-piece of a hearing device according to another embodiment of the invention with a body 2 and a vent extension 4, similar to the one shown in FIG. 2, however unlike the example of FIG. 2 the vent extension protrudes upwardly from the body 2 of the ear-piece. The shape and length of the vent extension 4 is adjusted such that its outer part abuts on and is guided within the helix 45. The outer part of the vent extension which is in the range of the helix 45 is referred to as helix section. The helix section may have a length in the range from 2 cm to 5 cm. There may also be no helix section at all in the sense that the vent extension just reaches barely to the helix region. The microphone opening 7 is in the lower part of the ear-piece body 2. The design of the example has the advantages that the opening 9 of the vent extension is relatively far away from the microphone opening and that the vent extension 4, despite of its length, is relatively well retained due retention provided by the helix 45.

Figure 4:
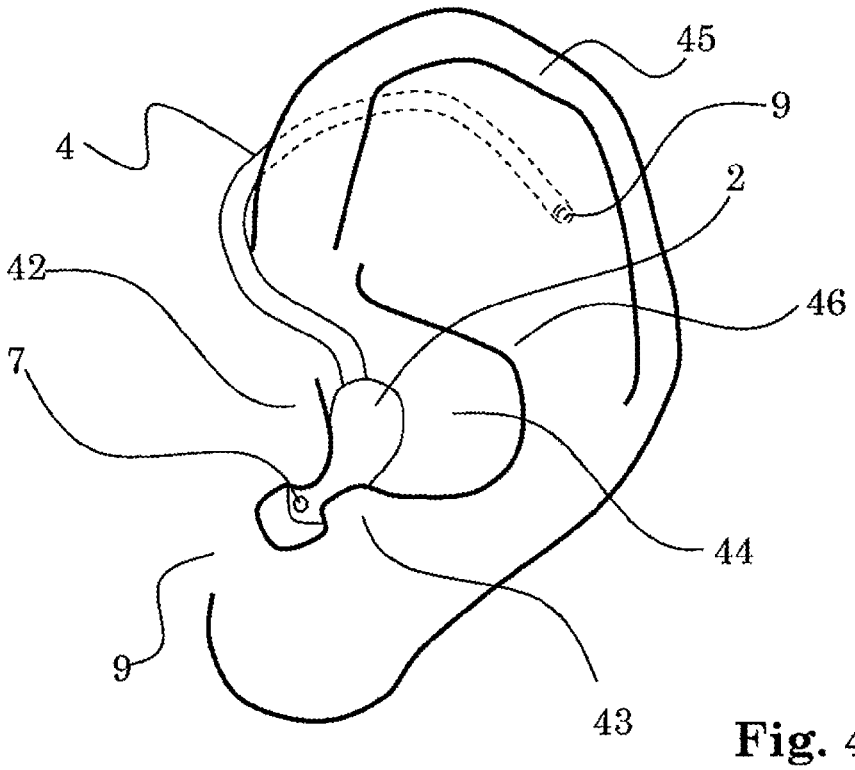
FIG. 4 shows an ear-piece of a hearing device while being worn in an ear of a user with a vent extension having an outer part being conducted in the trench between helix and cranium.

FIG. 4 shows an ear-piece of a hearing device according to a further embodiment of the invention with a body 2 and a vent extension 4, similar to the one shown in FIG. 3, however instead of being worn in the helix the outer part of the vent extension 4 is worn behind the helix 45, in the trench between helix and cranium, similar to the bows of spectacles. The part of the vent extension 4 in the range of the helix can here also be denominated helix section. Different lengths of helix sections can be envisioned, namely just a short length, e.g. about 1 cm, which is just long enough to keep the vent extension from bending away from the users body, or a long length, e.g. up to 7 cm, which provide excellent retention just as spectacle bows.

Figure 5:
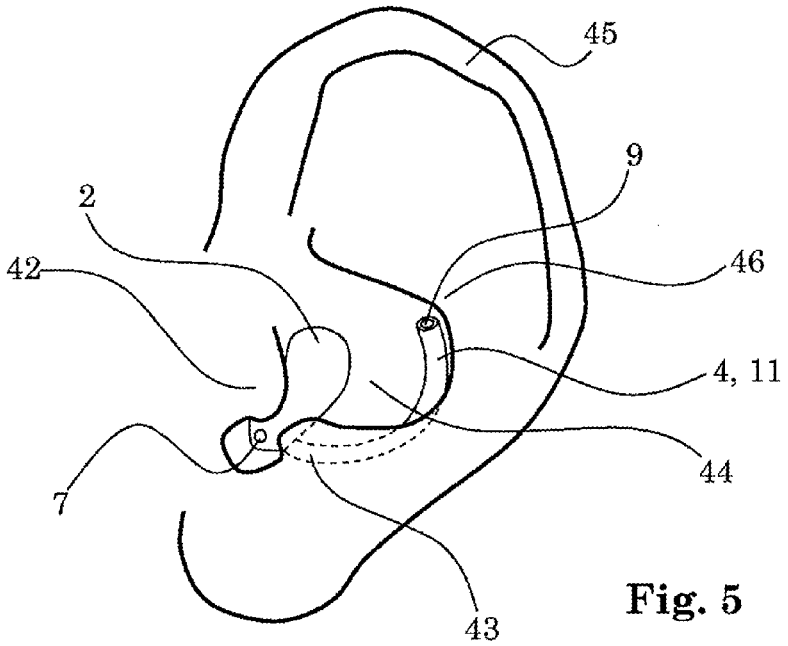
FIG. 5 shows an ear-piece of a hearing device with a vent extension which is designed to function as a concha clip.

FIG. 5 shows an ear-piece of a hearing device according a further embodiment of the invention with a body 2 and a vent extension 4, similar to the one shown in FIGS. 2 to 4, however, unlike the examples of FIG. 2 to 4, the vent extension 4 is designed to function as a concha clip 11. The hearing device may also be an in-the-ear hearing aid. The concha clip 11 is abutting on the edge of the concha 44 at the anti-helix 46. It is located inside the concha 44 and exerts an expanding force onto edge of the concha 44, at the anti-helix, but also, partly indirectly by body 2, at or near tragus 42 and antitragus 43. The concha clip 11 is bent resiliently during insertion of the ear-piece. Before insertion it may simply be straight, but may also be curved, but less than in its final position. In one embodiment the vent extension 4 is made from silicon. There may also be an adjustment to the anatomy of a specific individual, e.g. by an audiologist, prior to the actual use, in particular an adjustment of the length. However, also the shape of the concha clip 11, when released outside the ear, may be adjusted, for example, in case of a thermoplastic material, by heating. The concha clip 11 may not only "contribute" to retention, but may be providing a significant portion or at least half of the total retention, such that the ear-piece would, without it, not be sufficiently retained for normal everyday use. Solutions which combine vent extension and concha clip have the advantage of a reduced complexity, weight and cost, since one part may serve for two purposes. The distance between outer opening 9 and microphone opening 7 is preferably larger than 10 mm, in particular larger than 20 mm and in particular larger than 30 mm. The length of a vent extension 4 functioning as concha clip 11 is preferably between 20 mm and 60 mm, between 30 mm and 50 mm, or about 40 mm. The vent extension 4 is abutting on the surface of the body of the user preferably along at least half its length or along at least 75% of its length or along a length of at least 10 mm, in particular 20 mm.

It is to be noted that a design of the vent extension as shown in FIG. 5 is cosmetically very advantageous. Therefore it may also be chosen purely for cosmetic reasons without regarding the retention aspect. In this case no force upon the surfaces of abutment is necessary—and maybe not even desired—and an adjustment to the anatomy of the individual may be performed which causes the released state outside the ear substantially to be the same as the state within the ear during use.

Figure 6:
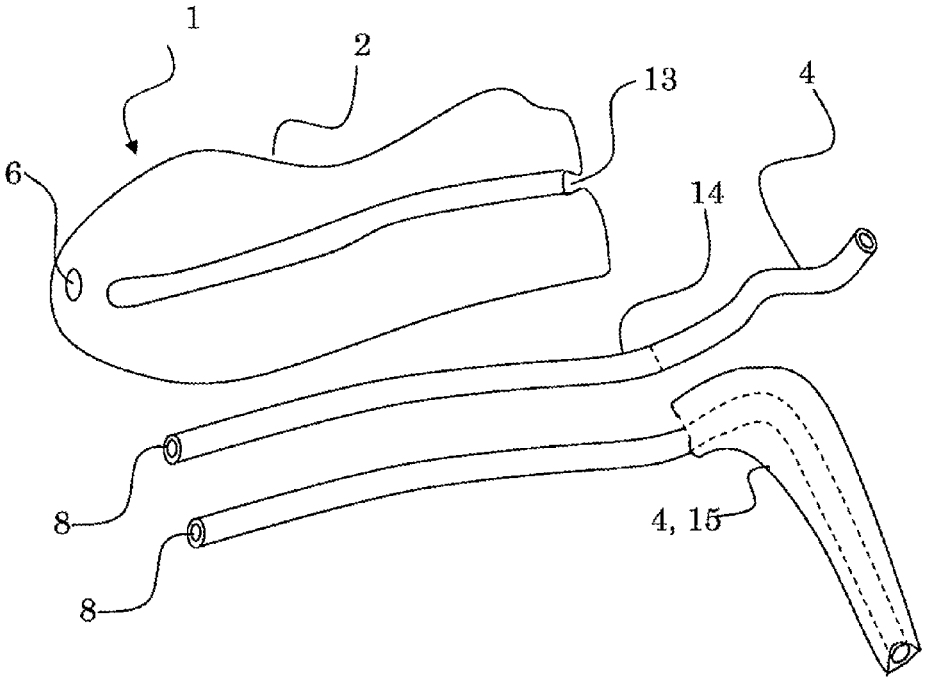
FIG. 6 shows a partly disassembled ear-piece of a hearing device with a trench for a vent tube as well as two examples of vent tubes to be inserted in the trench.

FIG. 6 shows a partly disassembled ear-piece 1 of a hearing device according to a further embodiment of the invention with a trench 13 for vent elements, such as a vent tube 14, as well as two examples of such vent elements to be inserted in the trench 13. In one example, the portion which forms the vent extension 4, i.e. the protruding portion, is designed as special retaining member 15 which is adapted to optimally fit into the concha in a way that the expanding force is well distributed upon the body surfaces for a comfortable fit and to avoid pressure marks. The cross sectional area of the retaining member 15 is substantially decreasing towards the distal end while the diameter of the vent passage is constant to allow an easy cleaning. The outside of the retaining member 15 may also in particular be substantially conical. Instead of a trench, also another recess such as a notch, slot, bore, drilling, socket or hollow structure may be provided. In the case where the body 2 comprises a printed shell or casing, the recess may be printed together with the shell or casing.

Figure 7:
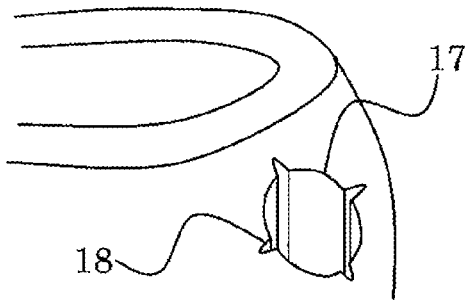
FIG. 7 shows a part of a hearing device shell with a socket for receiving a vent extension tube.

FIG. 7 shows a partial view a shell of an ear-piece of a hearing device according to a further embodiment of the invention. It comprises a recess, namely a socket 17, for receiving a vent extension tube or element. The socket 17 comprises gluing grooves 18 which are designed for receiving the glue which secures a vent extension tube or element in the socket 17. Gluing grooves may be provided in any of the embodiments comprising a vent tube or element, in particular the ones described referring to FIGS. 4 and 6. However, vent extension tubes or elements may also be affixed by other means such as force fit without glue.

Figure 8:
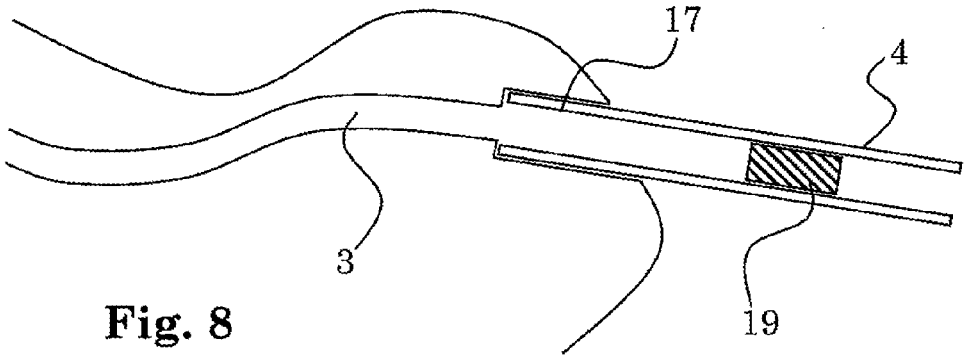
FIG. 8 shows a sectional view of an ear-piece of a hearing device with a vent extension tube comprising a damping element.

FIG. 8 shows a partial sectional view of a shell of an ear-piece of a hearing device according to a further embodiment of the invention. It also shows a vent extension 4. A damping element 19, in particular a porous filter, is arranged within the tube which forms the vent extension 4. A damping element 19 has the advantage that it increases the vent mass. There is less acoustic leakage and less susceptibility to feedback but still pressure equalization and moisture discharge. The damping element 19 further protects the vent passage 3 from contaminants entering from the outside, especially when positioned at the distal end. When combined with a cerumen protection on the inside or ear canal side a cleaning of the vent passage 3 may be necessary less frequently or not at all. This is especially advantageous in the case of long vent passages such as implemented by vent extensions leading out of the concha or combinations of vent extension and concha clip. The tube which forms the vent extension 4 as well as the damping element 19 may be selected and/or adjusted by an audiologist fitting the device to an individual. A set of different vent extension tubes or elements may be provided pre-equipped with different damper elements. The fitting process as well as changing the damper elements as a maintenance task is thereby facilitated. The damping element is mounted or exchanged together with the tube and needs not to be inserted in the tube. The same principle can also be applied to the cerumen protection in the case where the vent tube or element extends over the full length of the vent passage as described referring to FIG. 4, i.e. the cerumen protection can be replaced together with the vent tube or element.

FIGS. 6 to 8 show embodiments where the casing of the ear-piece body and the tube or element forming the vent extension are initially separate pieces which are assembled in a late manufacturing step. This has the advantage that the pieces can be easily made from different materials and with different techniques each selected to optimally suit its function. However, as an alternative it is also possible to manufacture these elements together as one piece, for example by a printing process.

It can be seen also from FIG. 6 to 8 that a vent tube or element which forms the vent extension 4 may either be provided over the full length of the vent passage such as in FIG. 6 or it can be provided substantially only at the extended section of the vent passage such as in FIG. 8. The term "substantially" is used here because it could also be provided in the range of a mounting. For example the vent tube in FIG. 8 is partially arranged in a socket 17 which belongs in the strict sense not to the extended section of the vent passage. Printed vent passages without a vent tube have the disadvantage that the vent diameter is usually limited by the printing process, e.g. to a minimum of 1.1 mm, and they may be difficult to clean. On the other hand they have the advantage that they need less space such that the ear-piece can be smaller and/or more powerful.

Figure 9:
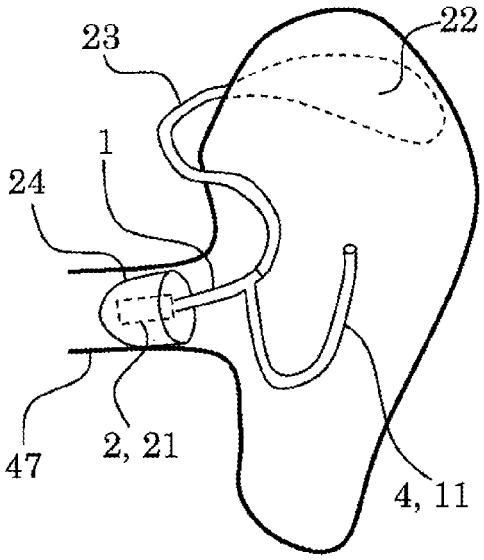
FIG. 9 shows a hybrid behind-the-ear in-the-ear hearing device with a one-size-fits-all ear-piece as well as a vent-extension functioning as concha clip.

FIG. 9 shows a hybrid behind-the-ear in-the-ear hearing device according to a further embodiment of the invention together with an ear of a user wearing the device. The ear-piece 1 is a so called one-size-fits-all ear-piece. In the strict sense "one-size-fits-all" has to be read as "one-size-fits-many", since there will always be extreme anatomies which cannot be fitted with a standard solution, or just a limited number of sizes such as small, medium and large may be provided. Further simple adjustments such as bending or length adjustments of tubes may be necessary. To sum it up, the essential feature of such ear-pieces is the fact that no ear impression must be taken. The ear-piece 1 comprises a body 2, a dome 24 and a vent extension 4 which also serves as concha clip 11. The behind-the-ear module 22 as well as the connector 23 are not considered to be part of the ear-piece 1. A microphone and a receiver are preferably comprised in the in-the-ear module 21 which forms the body 2 of the ear-piece 1 of the hearing device. The battery is preferably arranged in the behind-the-ear module 22. Signal processing means may be in either one of the modules 21, 22. The dome 24 serves for supporting the in-the-ear module 21 within the outer portion of ear canal 47 and for acoustically sealing the space between the in-the-ear module 21 and the ear canal 47. It is preferably made from a soft, resilient material.

Figure 10:
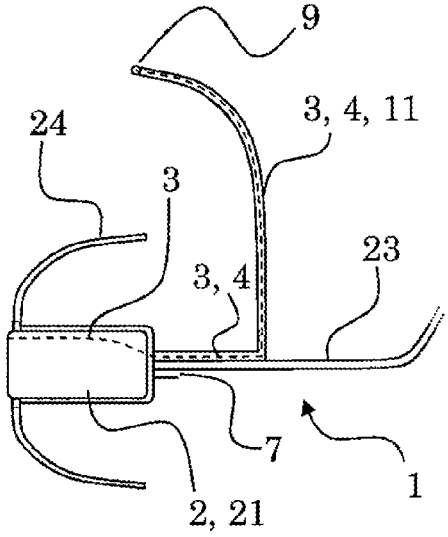
FIG. 10 shows a sectional view of the ear-piece of FIG. 7.

FIG. 10 shows a sectional view of the ear-piece 1 of FIG. 7. The vent extension 4 starts at the body 2 of the ear-piece 1, follows the module connector 23 and bends then of substantially in a right angle to form the concha clip 11. The vent passage 3 goes first through or along the body 2 and then through vent extension 4. The microphone opening 7 is preferably directly at the in-the-ear module 21 such that there is a relatively large distance between it and the outer opening 9 of the vent passage 3.

Generally, an adaptation of a vent extension to the anatomy of a specific individual may be performed by a modification, in particular by cutting or, in the case of a suitable material, by thermoplastic deformation. However, the adaptation may also be performed by replacing the element by an appropriate element selected from a kit or by a combination of both, replacement of the element and subsequent modification.

A vent tube may be provided for the full length of the vent passage as shown in FIG. 4 or for part of it, in particular substantially only for the extension part as shown in FIG. 6. Generally this tube is preferably translucent or otherwise cosmetically inconspicuous or appealing, such as being matched to the skin color, to the color of the remaining device parts or having a fashionable color which may reappear in clothing or other personal items. The tube may be in particular made from translucent soft silicone. Preferably the tube has a substantially circular cross section. The inner diameter is preferably constant and may be e.g. in the range from 0.8 mm to 2.5 mm, i.e. e.g. 0.9 mm, 1.1 mm, 1.5 mm or 1.8 mm. The wall thickness may be e.g. approximately 0.2 mm. A diameter of not less than 0.8 mm has the advantage that the tube can be cleaned with a standard tool such as a 0.7 mm rod with a handle. The total length of the vent passage may e.g. be in the range from 10 mm to 70 mm, such as e.g. 20 mm. Length and diameter may be selected depending on the desired vent mass or depending on the hearing loss, amplification requirements and/or ear anatomy of the user. There may also be two or more vent passages and in particular also two or more vent extensions.

A hearing device having a vent extension 4, which is adapted to the anatomy of a specific user, can be manufactured by a method, which comprises the following steps:

a) providing premanufactured components, said premanufactured components comprising at least a microphone module, an electronic circuit module and a receiver module;

b) manufacturing an ear-piece 1 comprising at least said microphone module, a vent passage 3 and at least one of:
   a vent extension,
   a mounting for a vent extension,
      said vent extension 4 being a protrusion extending said vent-passage 3 beyond a body 2 of said ear-piece 1;

c) assembling still unassembled components and adjusting the hearing device for a prospective user, said prospective user being a specific individual;

characterized by the step of d) adjusting said vent extension 4 to an anatomy of said prospective user such that said vent extension 4 is abutting on a surface of a body of said prospective user, wherein step d) is performed as a part of or together with step b) and/or step c).

The term "module" is used to indicate that besides of the main component, for example the microphone, electronic circuit and receiver, there might also be one or more auxiliary parts such as a housing, connectors, welding pads or additional circuitry. A mounting for a vent extension 4 can e.g. be designed as shown in FIGS. 7 and/or 8. As apparent to the person skilled in the art, the different manufacturing steps can be assigned to the participants in the manufacturing and supply chain in various ways. Typically there are the following participants in the manufacturing and supply chain:

component suppliers,
hearing aid manufacturer,
audiologist.

The audiologist is the participant who interacts directly with the user or prospective user of the hearing device.

Therefore an adjustment to an anatomy of the user will advantageously at least partially be performed by the audiologist.

The logical creation of a vent passage 3 and, as the case may be, a vent extension 4, can be performed separately from its physical creation. The term "logical creation" is used here to denominate the determination of vent data, i.e. information about the vent passage 3, such as vent mass, vent size, vent shape and/or vent location in respect to the ear-piece 1. The logical creation can also be referred to as modeling. The term "physical creation" is used here to denominate the actual material manufacturing.

The logical creation of the vent passage 3 and, as the case may be, it's extension 4 may be performed using a special vent modeling software. If there is already a software for modeling the shell of the ear-piece 1 this special vent modeling software will be advantageously integrated with it. However, similar calculations can also be performed fully or partially by a human, such as an audiologist. Usually, first so called "target data" is determined which indicates what is desirable and which is then modified to comply with physical constraints to obtain actually implementable data. It is to be noted that the manufacturing method can be applied to both, hearing devices where the shell of the ear-piece is a custom shell and hearing devices where ear-piece is "one-size-fits all" solutions having for example a "dome" to fit into the ear.

In the latter case there is generally no shell modeling software.

The physical creation of the vent extension 4 can, as already indicated, be performed in various ways, e.g.:

A) The shell of ear-piece 1 and the vent extension 4 are produced together by a printing process. In this case the adjustment of the vent extension 4 to the anatomy of the prospective user may be fully performed during the modeling, in particular by the software.

B) The shell of ear-piece 1 and the vent extension 4 are printed together, as in A), but a final adjustment, such as a bending or length adjustment, is performed manually by a human such as the audiologist.

C) The shell of ear-piece 1 is printed without vent extension 4, but is suited for the attachment of a vent extension 4, for example by having a connector recess or socket 17 for reception of a vent tube 14. Hence, the vent extension 4 initially is a separate element. The attachment and adaptation of the vent extension 4 mainly is a mechanical process and is advantageously performed by a human such as the audiologist.

Way A has the advantage that the final product may resemble calculated vent data very precisely and the quality of the result does not largely depend on the skills of the sales person or audiologist which is directly interacting with the prospective user of the device.

Accordingly, ways B and C have the advantage that a skilled audiologist may optimally and interactively adapt the device to the anatomy, but also to the preferences, of the prospective user. Further adjustments can be done in a follow-up adjustment session after the first use. It is to be noted that the interactive adaptation process of variant B and C represents a mixture of a logical and physical correction.

The logical creation of the vent passage 3 of a hearing aid may take into account the audiogram of the individual. Prior to the logical creation of the ear-piece an ear impression or ear scan may be taken to provide initial data for the logical process. The logical creation of the vent passage 3 may comprise determining target vent data, such as a target vent mass, and in particular determining the need for and, if applicable, the dimensions, shape and/or positioning of a vent extension 4. The modeling may also comprise determining whether occlusion and/or feedback-susceptibility measures are sufficiently low. The modeling must take into account manufacturing limitations regarding minimum dimensions and/or material strength. The final result should be an optimal trade-off in regard to occlusion, feedback-susceptibility, maximum gain, battery lifetime and cosmetic aspects. For this also a process known as "Acoustically Optimized Venting (AOV)" may be used.

The invention may be applied to hearing devices of many different kinds. However, in a plurality of embodiments it is applied to a hearing aid. A hearing aid is a device designed to compensate the hearing loss of an individual which is usually measured and specified by an audiogram. Typically environments sounds are picked up by a microphone, amplified and then presented to an ear by a receiver. Hearing aids may be classified by the location of their components, which may comprise in-the-ear, behind-the-ear and, for the sake of completeness, in-the-pocket. The location in-the-ear can be specified more precisely, e.g. by the terms in-the-canal or in-the-concha. The invention can be applied to all hearing aids which have an in-the-ear component with a vent passage, i.e. primarily in-the-ear hearing aids (ITE), in-the-canal hearing aids (ITC) and completely-in-the-canal hearing aids (CIC), but also hybrid behind-the-ear/in-the-ear hearing aids. Such hybrid hearing aids have for example the receiver and microphone in the ear and the battery and signal processor behind the ear, such as some canal-receiver-technology hearing aids (CRT), or they may be basically an in-the-ear hearing aid just having the battery behind the ear. It is to be noted that in-the-ear hearing aids may substantially consist of the ear-piece, i.e. there may be no further components necessary during their everyday use. The term "completely" in "completely-in-the-canal" is to be construed such that that the device may still have small and/or substantially invisible elements outside the canal, such as pull-out-cords or concha clips. Generally it is especially advantageous to apply the invention to hearing aids having an in-the-ear microphone because of its potential to increase the distance between an outer vent opening and such a microphone.

A hearing device may also be a hearing protection device. In this case acoustic leakage from outside into the ear canal is to be avoided. A vent extension according to the invention minimizes such leakage while maintaining a vent passage diameter size which is reasonable in regard to production a cleaning. The same applies to any kind of headset which is designed to deliver sound to the ear without acoustic leakage, i.e. keeping the sound in and/or environment noises out. Such a head set may be part of a communication system.

What is claimed is:

1. A hearing device comprising an ear-piece which is designed to be worn at least partially in an ear canal of a user of said hearing device, said ear-piece comprising a receiver opening for delivering sound into said ear canal, said ear-piece comprising a vent passage, wherein said vent passage is designed to connect, while said hearing device is worn, a space in said ear-canal in front of an eardrum of said user to an environment of said user, said vent passage having an inner opening towards said ear canal and an outer opening towards said environment, said inner opening being separate and spaced away from said receiver opening, said ear-piece further comprising a vent extension, said vent extension being a protrusion extending said vent passage beyond a body of said ear-piece, wherein said vent extension is adapted for abutting on a surface of a body of said user, wherein said vent extension has a length of at least 15 mm, and a distance between a microphone opening of said ear-piece and said outer opening is larger than 20 mm.

2. The hearing device according to claim 1, wherein said vent extension is adapted to be contributing to retention of said ear-piece in an ear of said user.

3. The hearing device according to claim 2, wherein said vent extension is designed to function as a concha clip, said concha clip being a part, which provides retention for said ear-piece, keeping said ear-piece from turning and from falling out of said ear-canal, which abuts, while said hearing device is worn, on the inside of an edge of a concha bowl of said user along at least a substantial portion of said edge and exerts a moderate force upon said edge along said abutment, said force being, due to the curved shape of said edge, an expanding force, and which is designed to be, while said hearing device is being inserted by said user, bent resilently, said bending causing a reduction of overall dimensions of said part which facilitates an insertion into said concha bowl.

4. The hearing device according to claim 1, wherein said vent extension is adapted such that said outer opening is at least one of outside of a concha of said user and abuts on a surface of a body of said user outside of a concha of said user.

5. The hearing device according to claim 1, wherein said vent extension is adapted such that it abuts on a surface of a body of said user at least one of along half a length of said vent extension and along a length of at least 10 mm.

6. The hearing device according to claim 5, wherein said vent extension is adapted such that it abuts on a surface of a body of said user at least along a length of 20 mm.

7. The hearing device according to claim 1, wherein said vent passage has a constant inner diameter in the range of said vent extension.

8. The hearing device according to claim 7, wherein said vent passage has a constant inner diameter over its full length or a diameter from 0.8 mm to 2.5 mm.

9. The hearing device according to claim 1, wherein said vent extension is made from a material comprising at least one of the following properties:

different from a material of a casing of said body of said ear-piece;

translucent or being otherwise cosmetically inconspicuous or appealing;

thermoplastic;

soft or resilient;

silicone.

10. The hearing device according to claim 1, wherein said vent extension is formed by a vent element which is connected to a casing of said body of said ear-piece, said vent element having substantially the shape of a tube.

11. The hearing device according to claim 10, wherein said vent element is affixed by at least one of glue and force fitting within a recess of said body of said ear-piece.

12. The hearing device according to claim 11, wherein said recess being a socket, trench, notch, slot, bore, drilling or hollow structure and said recess comprising one or more gluing grooves.

13. The hearing device according to claim 10, wherein said vent element reaching all the way to an ear canal side of said body of said ear-piece and said vent element being a vent tube.

14. The hearing device according to claim 1, wherein said hearing device is one or more of the following:

an in-the-ear hearing aid;

an in-the-canal hearing aid;

a completely-in-the-canal hearing aid;

a hybrid behind-the-ear / in-the-ear hearing aid;

a canal-receiver-technology hearing aid;

a behind-the-ear hearing aid with an in-the-ear microphone;

an in-the-ear hearing aid having a behind-the-ear battery;

a hearing protection device;

a headset for delivering sound to an ear.

15. The hearing device according to claim 1, wherein said ear-piece is one of the following:

a one-size-fits-all or one-size-fits-many ear-piece; or a custom made ear-piece.

16. The hearing device according to claim 15, wherein said one-size-fits-all or one-size-fits-many ear-piece comprises a dome which is made from a soft material and is adapted for providing an acoustic seal between said ear-piece and an ear canal, and a casing of said body of said custom made ear-piece comprises an ear-mold shell made of a substantially hard material, and wherein said material comprises printed acrylic.

17. The hearing device according to claim 1, wherein said vent passage comprises at least one of a damping element and a cerumen protection.

18. The hearing device according to claim 17, wherein said vent passage comprises at least a porous filter.

19. The hearing device according to claim 1, wherein a shape of said vent extension is at least one of bendable and having an adjustable length to an anatomy of said user, said user being a specific individual.

20. The hearing device according to claim 1, wherein said vent extension includes an unconnected outer opening exposed to the environment.

21. The hearing device according to claim 1, wherein an outer part of the vent extension is adapted to abut on and be guided within a helix of the body.

22. The hearing device according to claim 21, wherein the outer part has a length from 2 cm to 5 cm.

23. The hearing device according to claim 21, wherein the outer part has a length from 1 cm to 7 cm.

24. The hearing device according to claim 1, wherein an outer part of the vent extension is adapted to be worn in between a helix and a cranium of the body.

25. The hearing device according to claim 1, wherein the vent extension comprises a retaining member that is substantially conical in shape such that a cross-sectional area of the retaining member is substantially decreasing towards a distal end of the vent extension.

26. A method for manufacturing a hearing device comprising an ear-piece which is designed to be worn at least partially in an ear canal of a user of said hearing device, the method comprising the steps of:

a) providing pre-manufactured components, said pre-manufactured components comprising at least a microphone module, an electronic circuit module, and a receiver module for delivering sound into said ear canal;

b) manufacturing an ear-piece comprising at least said microphone module, a vent passage and a vent extension, said vent extension being a protrusion extending said vent-passage beyond a body of said ear-piece, wherein a shape of said vent extension is at least one of bendable and having an adjustable length, wherein said vent passage is designed to connect, while said hearing device is worn, a space in said ear-canal in front of an eardrum of said user to an environment of said user, further wherein said vent passage having an inner opening towards said ear canal and an outer opening towards said environment, said inner opening being separate and spaced away from said receiver opening;

c) assembling still unassembled components and adjusting the hearing device for a prospective user, said prospective user being a specific individual, d) adjusting said vent extension to an anatomy of said prospective user such that said vent extension is abutting on a surface of a body of said prospective user, wherein said vent extension has a length of at least 15 mm, and a distance between a microphone opening of said ear-piece and said outer opening is larger than 20 mm, and wherein step d) is performed as a part of or together with at least one of step b) and step c).

27. A hearing device comprising an ear-piece which is designed to be worn at least partially in an ear canal of a user of said hearing device, said ear-piece comprising a receiver opening for delivering sound into said ear canal, said ear-piece comprising a vent passage, wherein said vent passage is designed to connect, while said hearing device is worn, a space in said ear-canal in front of an eardrum of said user to an environment of said user, said vent passage having an inner opening towards said ear canal and an outer opening towards said environment, said inner opening being separate and spaced away from said receiver opening, said ear-piece further comprising a vent extension, said vent extension being a protrusion extending said vent passage beyond a body of said ear-piece, wherein said vent extension is adapted for abutting on a surface of a body of said user, and wherein wherein said vent extension has a length of at least 25 mm, and a distance between a microphone opening of said ear-piece and said outer opening is 30 mm.

* * * * *

UNITED STATES PATENT AND TRADEMARK OFFICE

CERTIFICATE OF CORRECTION

PATENT NO. : 8,855,347 B2
APPLICATION NO. : 13/380210
DATED : October 7, 2014
INVENTOR(S) : Sëbastien Aubert It is certified that error appears in the above-identified patent and that said Letters Patent is hereby corrected as shown below:

In the claims,

Column 14, line 31, please replace “and wherein wherein said” with -- and wherein said --

Signed and Sealed this
Twenty-fourth Day of February, 2015

Michelle K. Lee

Michelle K. Lee
*Deputy Director of the United States Patent and Trademark Office*